US008340561B2

(12) United States Patent
Kopp

(10) Patent No.: US 8,340,561 B2
(45) Date of Patent: Dec. 25, 2012

(54) CLEANING ARRANGEMENT FOR A MOVING ELEMENT TO BE CLEANED IN AN ELECTROGRAPHIC PRINTING APPARATUS

(75) Inventor: Walter Kopp, Taufkirchen (DE)

(73) Assignee: Océ Printing Systems GmbH, Poing (DE)

( * ) Notice: Subject to any disclaimer, the term of this patent is extended or adjusted under 35 U.S.C. 154(b) by 391 days.

(21) Appl. No.: 12/635,034

(22) Filed: Dec. 10, 2009

(65) Prior Publication Data

US 2010/0150626 A1 Jun. 17, 2010

(30) Foreign Application Priority Data

Dec. 11, 2008 (DE) ..... 10 2008 061 638

(51) Int. Cl.
*G03G 21/00* (2006.01)

(52) U.S. Cl. ..... 399/345; 399/349; 399/350

(58) Field of Classification Search ..... 399/345, 399/343, 349, 350, 351, 98, 99, 100
See application file for complete search history.

(56) References Cited

U.S. PATENT DOCUMENTS

| | | | | | |
|---|---|---|---|---|---|
| 3,740,789 | A | * | 6/1973 | Ticknor | 399/351 |
| 3,742,551 | A | * | 7/1973 | Oriel | 15/256.51 |
| 3,848,992 | A | * | 11/1974 | Smith | 399/350 |
| 3,854,814 | A | * | 12/1974 | Jones | 399/350 |
| 4,279,501 | A | * | 7/1981 | Kojima et al. | 399/345 |
| 4,519,699 | A | * | 5/1985 | Mayer et al. | 399/345 |
| 4,619,523 | A | * | 10/1986 | Maeda et al. | 399/345 |
| 4,640,608 | A | * | 2/1987 | Higaya et al. | 399/345 |
| 4,702,591 | A | * | 10/1987 | Tsuda et al. | 399/345 |
| 4,969,015 | A | * | 11/1990 | Sanpe | 399/345 |
| 5,103,265 | A | | 4/1992 | Kohyama | |
| 5,107,304 | A | | 4/1992 | Haneda et al. | |
| 5,250,991 | A | * | 10/1993 | Ikeda | 399/100 |
| 6,246,856 | B1 | | 6/2001 | Kopp et al. | |
| 6,321,052 | B1 | | 11/2001 | Yamashina et al. | |
| 6,505,024 | B2 | | 1/2003 | Kayahara et al. | |
| 7,251,448 | B2 | | 7/2007 | Pozniakas et al. | |
| 2006/0029438 | A1 | | 2/2006 | Kitayama | |

FOREIGN PATENT DOCUMENTS

| | | |
|---|---|---|
| DE | 25 57 622 | 7/1976 |
| DE | 690 14 411 T2 | 12/1990 |
| EP | 0 342 368 | 11/1989 |
| GB | 1 464 115 | 2/1977 |
| GB | 1 482 037 | 8/1977 |
| WO | WO 98/39691 | 9/1998 |

OTHER PUBLICATIONS

Patent Abstracts of Japan Publication No. 04018585 A—Publication Jan. 22, 1992.

* cited by examiner

*Primary Examiner* — Sandra Brase
(74) *Attorney, Agent, or Firm* — Schiff Hardin LLP

(57) ABSTRACT

In a cleaning arrangement for a moving element to be cleaned in an electrographic printing apparatus, a cleaning element is provided that has a cleaning member for cleaning which rests on a surface of the moving element to be cleaned. A drive unit for the cleaning element is provided that actuates the cleaning element such that the cleaning member cleans the surface of the moving element to be cleaned region-by-region.

17 Claims, 5 Drawing Sheets

RE2

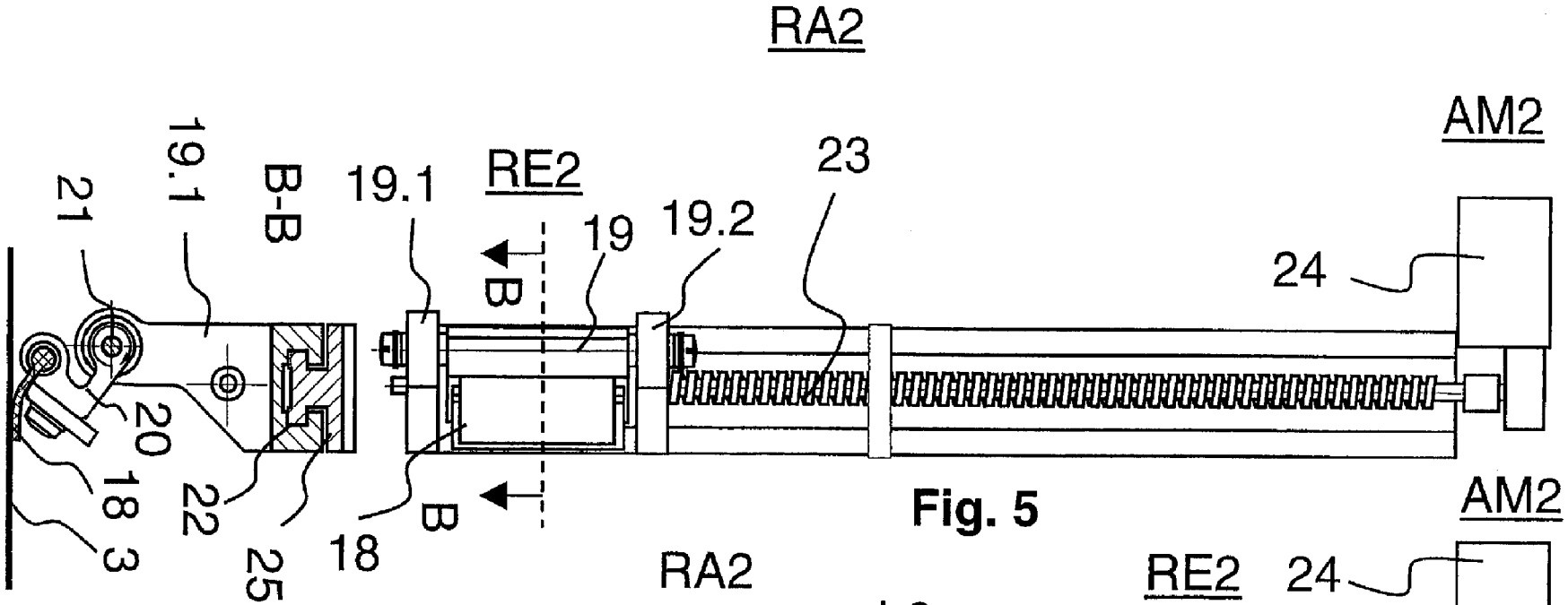
Fig. 5
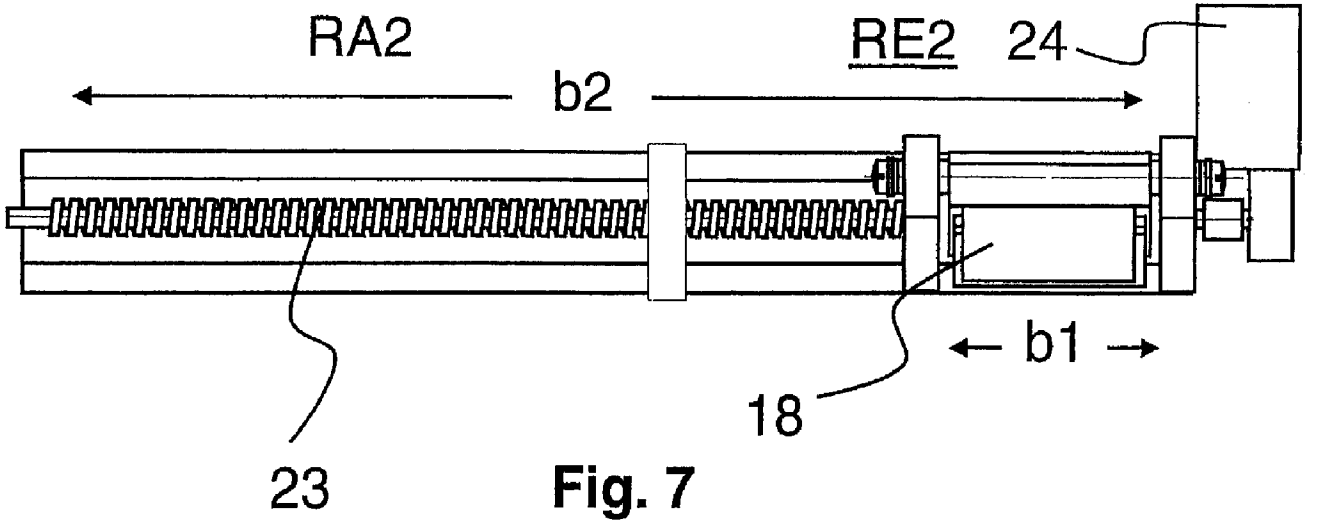
Fig. 7
Fig. 6

CLEANING ARRANGEMENT FOR A MOVING ELEMENT TO BE CLEANED IN AN ELECTROGRAPHIC PRINTING APPARATUS

BACKGROUND

Electrographic printing or copying apparatuses are known; see for example WO 98/39691 A2 (U.S. Pat. No. 6,246,856 B1). In such a printing or copying apparatus, charge images of the images to be printed are generated by a character generator on a photoconductor element (for example a photoconductor belt or a photoconductor drum) charged to a charge potential by a charging unit via discharging to a discharge potential. The photoconductor element is subsequently moved past developer stations, respectively per color given color printing. These developer stations transport developer (comprised of toner and carrier, for example) to the photoconductor element. Toner transfers to the photoconductor element and inks this corresponding to the charge images on the photoconductor element. In color printing the toner images collected into a color image on a transfer belt are ultimately transfer-printed onto a printing substrate web and are fixed thereon. The precise workflow of the printing method can be learned from WO 98/39691 A2, the content of which is herewith incorporated into this disclosure.

FIG. 1 shows such a printing apparatus DR. A rotating photoconductor belt 3 as a photoconductor element is charged by a charging unit 2 (for example a corotron) to a charge potential. Charge images of the images to be printed are subsequently generated by a character generator 1 (for example an LED comb) on the photoconductor belt 3. For this the photoconductor belt 3 is discharged. The charge images are inked with toner into toner images via at least one developer station 6 with a developer roller. The individual toner images are transfer-printed onto, for example, a printing substrate web 7 at a transfer printing station 8. After the transfer printing, a residual toner remains on the photoconductor belt 3, which residual toner is initially recharged by a cleaning corotron 5 in order to then be cleaned off by a cleaning unit 4.

The cleaning unit 4 can, for example, have cleaning brushes 9 to remove the residual toner image from the surface of the photoconductor belt 3. The hairs of the cleaning brushes 9 lie at an electrical potential whose polarity is chosen so that the charged toner particles deposit on the brush hairs. The toner particles are thereby pushed from the surface of the photoconductor belt 3 by the mechanical brushing process in order to subsequently be able to electrostatically accumulate on the brush hairs. From a roller arrangement with a cleaning roller 10 that sweeps across the brush hairs of the cleaning brush 9 that have accumulated toner particles, the toner particles are again transferred via electrical fields from the brush hairs of the cleaning brush 9 to the cleaning roller 10 and are mechanically cleaned therefrom.

A method to operate an electrophotographic copying apparatus in which a cleaning of the photoconductor is conducted after the end of the copying operation is known from DT 25 57 622 A1. The photoconductor is thereby initially recharged in a pre-cleaning station. The photoconductor is then cleaned in a cleaning station with the aid of a triboelectrically charged brush.

DE 690 14 411 T2 describes an image generation apparatus that operates according to the electrophotographic principle. The apparatus has a cleaning device that recharges the residual toner on the photoconductor drum and subsequently cleans this by means of a brush.

The toner particles are slid across the photoconductor belt 3 by the mechanical detaching of the toner particles on the photoconductor belt 3 by the brush hairs of the cleaning brush 9, which has the result that the finest toner components accumulate on the surface of the photoconductor belt 3. This contamination grows over the course of the printing operation into a film on the surface of the photoconductor belt 3. The film interferes with the exposure of the surface of the photoconductor belt 3 and leads to disruption relevant to the print image.

To prevent the formation of the film on the surface of the photoconductor belt 3, a cleaning arrangement RA (for example with a gummy cleaning blade) is arranged on the surface of the photoconductor belt 3 in order to prevent the build-up of this film. Deposits of the smallest particles are removed from the photoconductor belt 3 by the cleaning arrangement RA before a growth of the film can be created.

The composition of the film is comprised of the smallest toner particles (for example silica) with a size of a few nanometers. These small particles are held on the surface of the photoconductor belt 3 with very strong adhesion forces. The electrical and mechanical forces of the brush hairs of the cleaning brush 9 are not sufficient to detach these particles from the surface of the photoconductor belt 3. This means that the cleaning arrangement RA must be pressed onto the surface of the photoconductor belt 3 with a correspondingly large force in order to capture and move the particles.

Since these particles (for example silica) are also very abrasive, the photoconductor belt 3 is slowly but continuously eroded during the cleaning. This has the result that the transport layer of the photoconductor 3 becomes increasingly thinner. Furthermore, the uniformity of the wear across the width of the photoconductor belt 3 becomes ever poorer with the increase of the wear. Two problems thereby occur that negatively affect the print quality:

The first problem results from the increasingly thinner transport layer of the photoconductor belt 3. The thinner that the transport layer of the photoconductor belt 3 becomes, the greater the danger of breakdowns of the charge applied to the photoconductor belt 3 to the metallization (reference ground) of the photoconductor belt 3. The breakdowns have the effect of small black points in the developed print image. Therefore the thickness of the photoconductor belt layer may not fall below a specific thickness.

The second problem results from the non-uniformity of the layer thickness across the width of the photoconductor belt 3. The charge that is applied with the corotron unit 2 to the transport layer of the photoconductor belt 3 is proportional to the layer thickness of the photoconductor belt 3. Thinner layer regions of the photoconductor belt 3 do not charge as strongly; to the contrary, thicker layer regions charge more strongly. The created charge regions on the photoconductor belt 3 are primarily recognizable as lighter and darker tracks in print rasters.

SUMMARY

It is an object to specify a cleaning arrangement in which the wear of a moving element to be cleaned in an electrographic printing apparatus is minimal. In particular, it is an object to keep the wear of the surface and the non-uniformity of the wear across the surface of a photoconductor belt as low as possible in the cleaning.

In a cleaning arrangement for a moving element to be cleaned in an electrographic printing apparatus, a cleaning element is provided that has a cleaning member for cleaning which rests on a surface of the moving element to be cleaned. A drive unit for the cleaning element is provided that actuates the cleaning element such that the cleaning member cleans the surface of the moving element to be cleaned region-by-region.

BRIEF DESCRIPTION OF THE DRAWINGS

FIG. 5 shows the cleaning arrangement in plan view in a second embodiment of the invention when the cleaning member is at its first end position;

FIG. 6 is a sectional view through the cleaning element according to FIG. 5 at the point B-B in side view;

FIG. 7 shows the cleaning arrangement according to FIG. 5 in plan view when the cleaning member is at its second end position;

DESCRIPTION OF THE PREFERRED EMBODIMENTS

Figure 1:
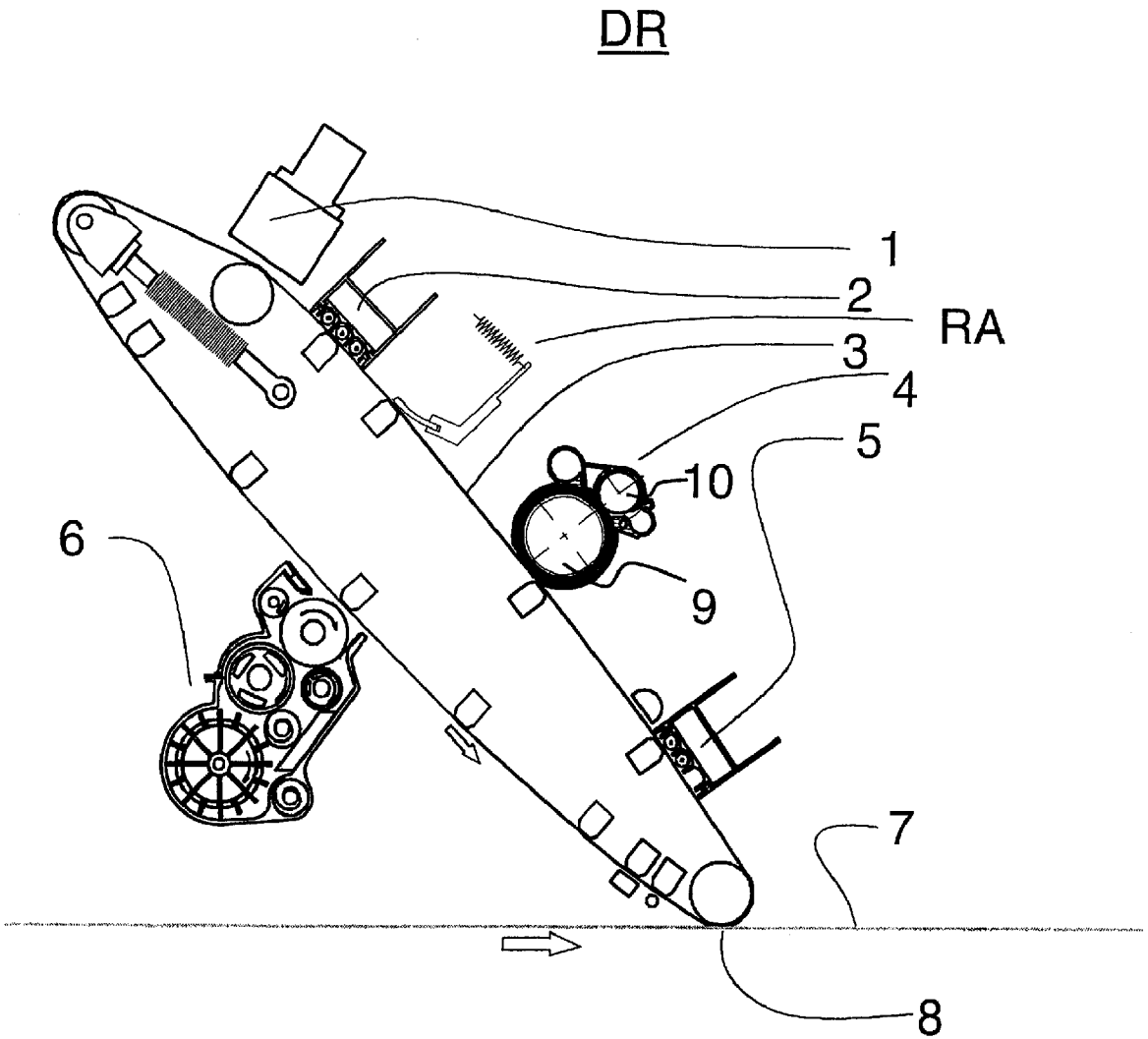
FIG. 1 is a section of a printing group with a photoconductor belt with function units arranged thereon.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated devices and such further applications of the principles of the invention as illustrated as would normally occur to one skilled in the art to which the invention relates are included.

The cleaning arrangement thus has a cleaning element and an actuator element. The cleaning element provides a cleaning member that rests on the surface of the element to be cleaned and cleans the toner components from the surface of the element to be cleaned.

In order to keep the wear low, a drive unit actuates the cleaning element such that the cleaning element does not always rest on the surface regions of the element to be cleaned.

Via the preferred embodiment, the time in which wear is caused, in which the cleaning members rest on the element to be cleaned, is reduced. The wear is thereby no longer as great per time unit.

In the following, the preferred embodiment in connection with a photoconductor belt is described as an element to be cleaned, without the invention being limited to this. Namely, the element to be cleaned could also be a photoconductor drum or a transfer belt.

In a first embodiment of the invention, the posed problem can be solved in that the cleaning element has a cleaning member that extends across an entire width of the photoconductor belt when the cleaning element is operated such that said cleaning member rests on the photoconductor belt only in time intervals. In this mode of operation, the cleaning means is pivoted onto the photoconductor belt for cleaning and is pivoted away from the photoconductor belt again after a predetermined time interval. This process is continuously repeated, wherein the time during which the cleaning means rests on the photoconductor belt is adjusted such that the photoconductor belt is sufficiently cleaned; however, the wear of the photoconductor belt is thereby kept to a minimum. For example, the time interval can comprise at least one complete revolution of the photoconductor belt.

In a second embodiment of the invention, the cleaning arrangement has the function units listed in the following:

- a cleaning element with a cleaning member for the photoconductor belt resting on said photoconductor belt is provided,
- the cleaning member of the cleaning element is executed with a smaller width in comparison to the width of the photoconductor belt so that the cleaning member rests on only a partial region of the total surface to be cleaned on the photoconductor belt,
- a drive unit is provided that is coupled with the cleaning element and that moves the cleaning element (and therefore the cleaning member) back and forth transverse to the movement direction of the photoconductor belt.

It is advantageous when the cleaning element of the second embodiment is arranged such that it can be displaced in a guide aligned transverse to the movement direction of the photoconductor belt so that it can be moved back and forth in the guide transverse to the photoconductor belt.

In the second embodiment, a drive spindle driven by a drive motor can be provided as a drive unit with which the cleaning element is coupled such that the cleaning element is moved in the guide upon rotation of the drive spindle. If the drive motor is executed such that it can change its rotation direction, the cleaning element (and therefore the cleaning member) can be moved in both directions transversely across the photoconductor belt. The cleaning member of the cleaning element thereby continuously rests on the photoconductor belt and cleans a partial region of the surface of the photoconductor belt.

The guide can be designed as a guide rail and guide groove, wherein the guide rail in the cleaning arrangement is arranged transverse to the photoconductor belt and interacts with the guide groove arranged in the cleaning element. If the cleaning element has a sled with the guide groove with which it is directed on the guide rail, wherein the sled is coupled with the drive spindle, the sled (and therefore the cleaning member) can be moved back and forth on the guide rail transverse to the photoconductor belt, for example via rotation of the drive spindle in the one or the other direction.

A sufficient cleaning of the photoconductor belt is then achieved when, in the second embodiment, the width of the cleaning member is chosen in a range from ½ to 1/10 of the width of the photoconductor belt.

The cleaning member can be realized as a cleaning blade that is aligned in the direction of the movement of the photoconductor belt.

If the cleaning element provides a cleaning blade as a cleaning member, the cleaning arrangement according to the preferred embodiment can have the following function units:

- the cleaning blade resting on the photoconductor belt, which cleaning blade is arranged on the one end of an accommodation linkage that is borne at its other end such that it can rotate on a rotation axle arranged in the sled,
- a spring element arranged on the accommodation linkage and therefore pushes on the cleaning blade in the direction of the photoconductor belt,
- the sled directed in the guide rail, the drive motor that moves the sled across the drive spindle and therefore moves the cleaning blade transversely back and forth across the photoconductor belt.

Since the cleaning blade in the second embodiment is narrower than the photoconductor belt and is moved back and forth on the photoconductor belt, the time during which wear is produced (in which the cleaning blade rests on the photoconductor belt) is reduced. The erosion of the transport layer of the photoconductor belt is thereby less per time unit, and the photoconductor belt can therefore be used longer.

An additional advantage according to the second embodiment is that no load angle changes occur in the drive motor for the photoconductor belt because the force of friction of the cleaning blade that counteracts the movement of the photoconductor belt remains constant since the cleaning blade does not need to be pivoted away from the photoconductor belt during the printing process. Thus no print image disruptions occur in finely rastered surfaces.

An additional advantage of the preferred embodiment, and in fact in both embodiments, is that the lifespan of the photoconductor belt is increased. The photoconductor belt is an expensive consumable material that must be swapped out depending on the wear. In electrographic printing apparatuses that operate in a high speed environment, the lifespan of the photoconductor belt is a decisive cost factor that is of great importance for the profitability of a printing system.

The print quality over the run time of the photoconductor belt is additionally maintained longer because the layer thickness difference over the width of the photoconductor belt can be kept down over a longer time period since the absolute average wear per time period is less significant.

The units essential for the explanation of the preferred embodiment are shown in the drawing Figures; parts that are non-essential for the function of the preferred embodiment, such as covering of the cleaning arrangement or housing parts, are omitted.

FIG. 1 has already been explained above.

In the following explanation, the cleaning arrangement RA has a cleaning element RE that provides a cleaning blade (for example) for the cleaning of the element to be cleaned (in the following a photoconductor belt 3).

Figures 2, 3:
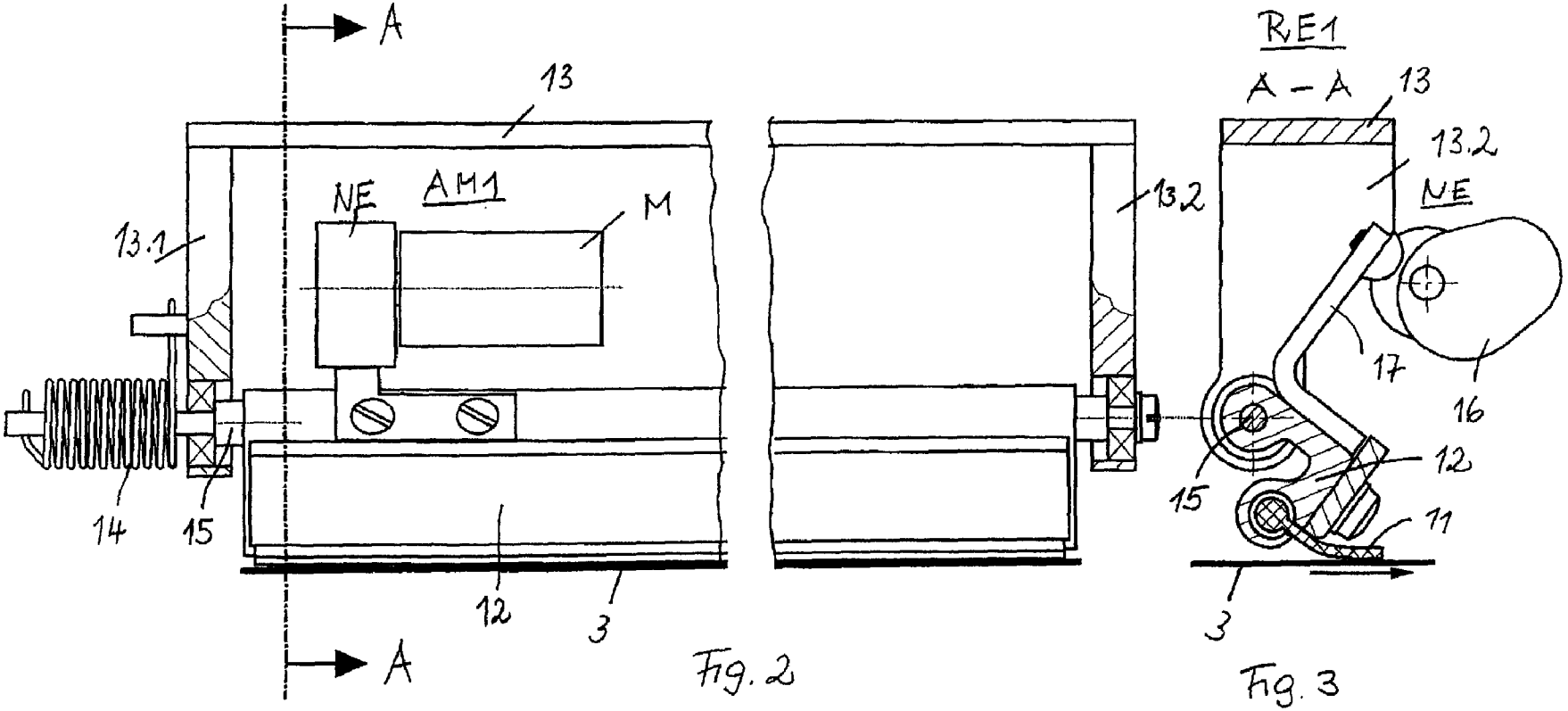
FIG. 2 is a cleaning arrangement in a first embodiment of the invention.
FIG. 3 is a slice through the cleaning arrangement according to FIG. 2 at the point A-A when the cleaning member is pivoted onto the photoconductor belt.
Figure 4:
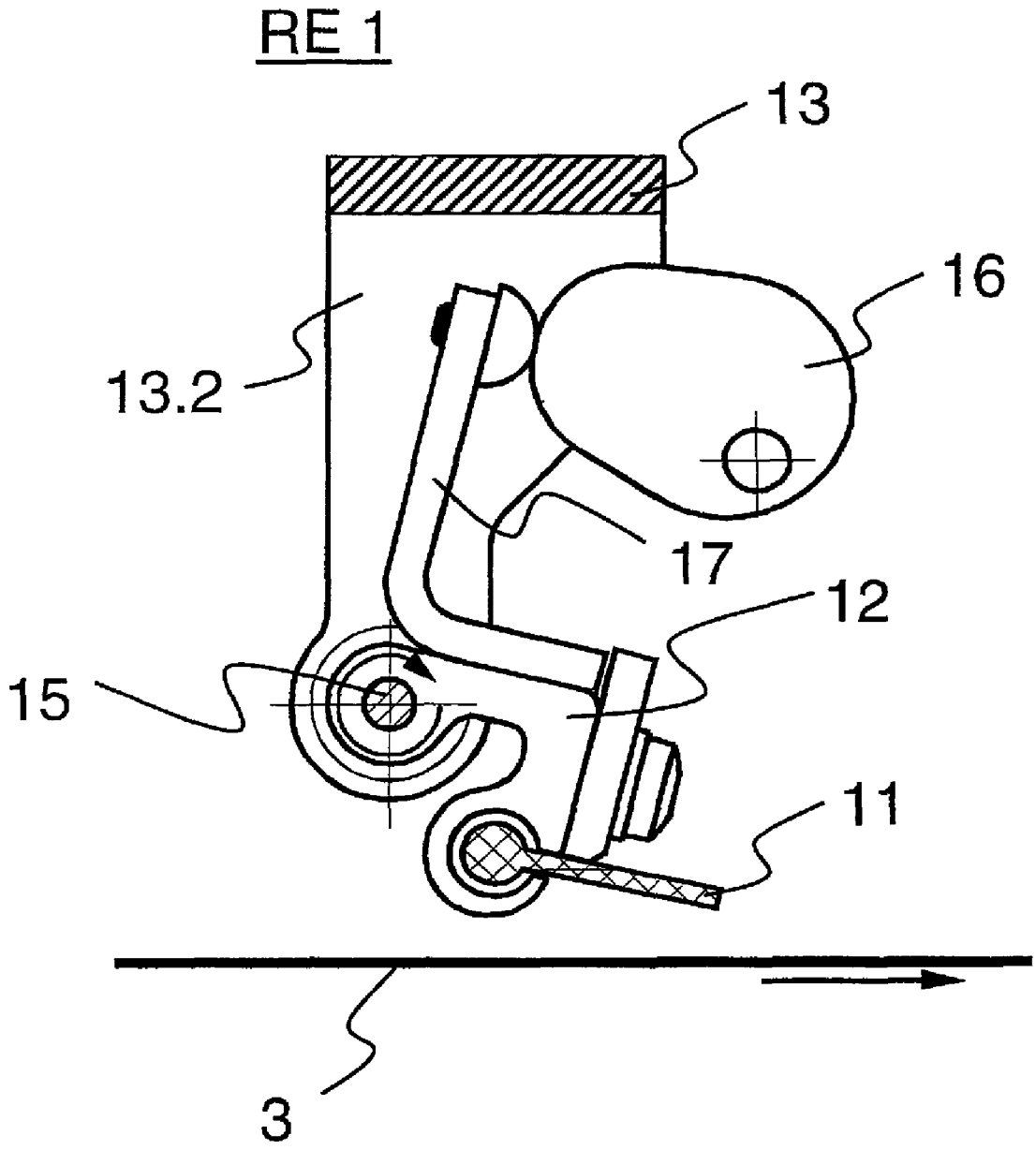
FIG. 4 is a slice through the cleaning arrangement according to FIG. 2 at the point A-A when the cleaning member is pivoted away from the photoconductor belt.

FIGS. 2 through 4 refer to a first embodiment of the invention (called a cleaning arrangement RA1 in the following). FIG. 2 shows a cleaning element RE1 of the cleaning arrangement RA1 in a front view. This cleaning element RE1 has a cleaning blade 11, an accommodation linkage 12 for the cleaning blade 11, and a torsion spring 14 that presses the accommodation linkage 12 (and therefore the cleaning blade 11) against the photoconductor belt 3. The cleaning blade 11 extends across the width of the photoconductor belt 3. The accommodation linkage 12 is borne at one end in limbs 13.1 and 13.2 of a pillow block 13 on a rotation axle 15 such that the accommodation linkage 12 can rotate, and bears the cleaning blade 11 at the other end. The accommodation linkage 12 and the cleaning blade 11 are accordingly pressed onto the photoconductor belt 3 due to the elastic force of the torsion spring 14.

A drive unit AM1 (for example a cam device NE with a cam 16 driven by a cam motor M and an arm 17) can be used to pivot onto and away from the cleaning blade 11, of which drive unit AM1 only the arm 17 and the cam 16 are shown in FIGS. 3 and 4 but not the cam motor M (which is drawn in FIG. 3, however). To pivot the cleaning blade 11 away from the photoconductor belt 3, the cam 16 is rotated until the cam 16 rests on the arm 17 that is connected with the accommodation linkage 12. Given further rotation of the cam 16, the arm 17 slides along on the cam 16 and rotates the accommodation linkage 12 counter to the elastic force of the torsion spring 14 so that the cleaning blade Ills lifted from the photoconductor belt 3 (FIG. 4). If the cam 16 is rotated further, the arm 17 detaches again from the cam 16 and releases the accommodation linkage 12; the torsion spring 14 rotates the accommodation linkage 12 (and therefore the cleaning blade 11) towards the photoconductor belt 3 so that this rests on the photoconductor belt 3 (FIG. 3).

Corresponding to FIGS. 3 and 4, the cleaning blade 11 can thus be pivoted onto the photoconductor belt 3 or away from this. In the first embodiment of the invention, these functions can be utilized to clean the photoconductor belt 3, given which the wear of the photoconductor belt 3 is kept low. It is a requirement that the cleaning element RE1 have a cleaning blade 11 that extends over the width of the photoconductor belt 3. The cleaning element RE1 can then be operated such that the cleaning blade 11 rests on the photoconductor belt 3 only in time intervals; the cleaning blade 11 is thus pivoted onto the photoconductor belt 3 for cleaning (FIG. 3) and is pivoted away from the photoconductor belt 3 again after a predetermined time interval (FIG. 4). This procedure can be repeated, wherein the time interval during which the cleaning blade 11 rests on the photoconductor belt 3 is set such that the photoconductor belt 3 is sufficiently cleaned; the wear of the photoconductor belt 3 is kept to a minimum, however.

For this mode of operation, the cam device NE can be used when the cam motor M driving the cam 16 is controlled corresponding to the predetermined time intervals.

A second embodiment of the invention (which is called cleaning device RA2 in the following and is subsequently described) arises from FIG. 5 through 9. In this embodiment, the cleaning arrangement RA2 has a cleaning element RE2 that provides a cleaning member (for example a cleaning blade 18) with a smaller width in comparison to the photoconductor belt 3.

FIG. 5 shows the cleaning arrangement RA2 in plan view; FIG. 6 shows the cleaning arrangement RE2 of FIG. 5 in a section at the point B-B in side view, wherein the section of the cleaning element RE2 lies between legs 19.1 and 19.2 of a sled 19. In addition to the cleaning element RE2, the cleaning arrangement RA2 has a drive unit AM2 that can move the cleaning element RE2 transverse to the movement direction of the photoconductor belt 3.

Figure 8:
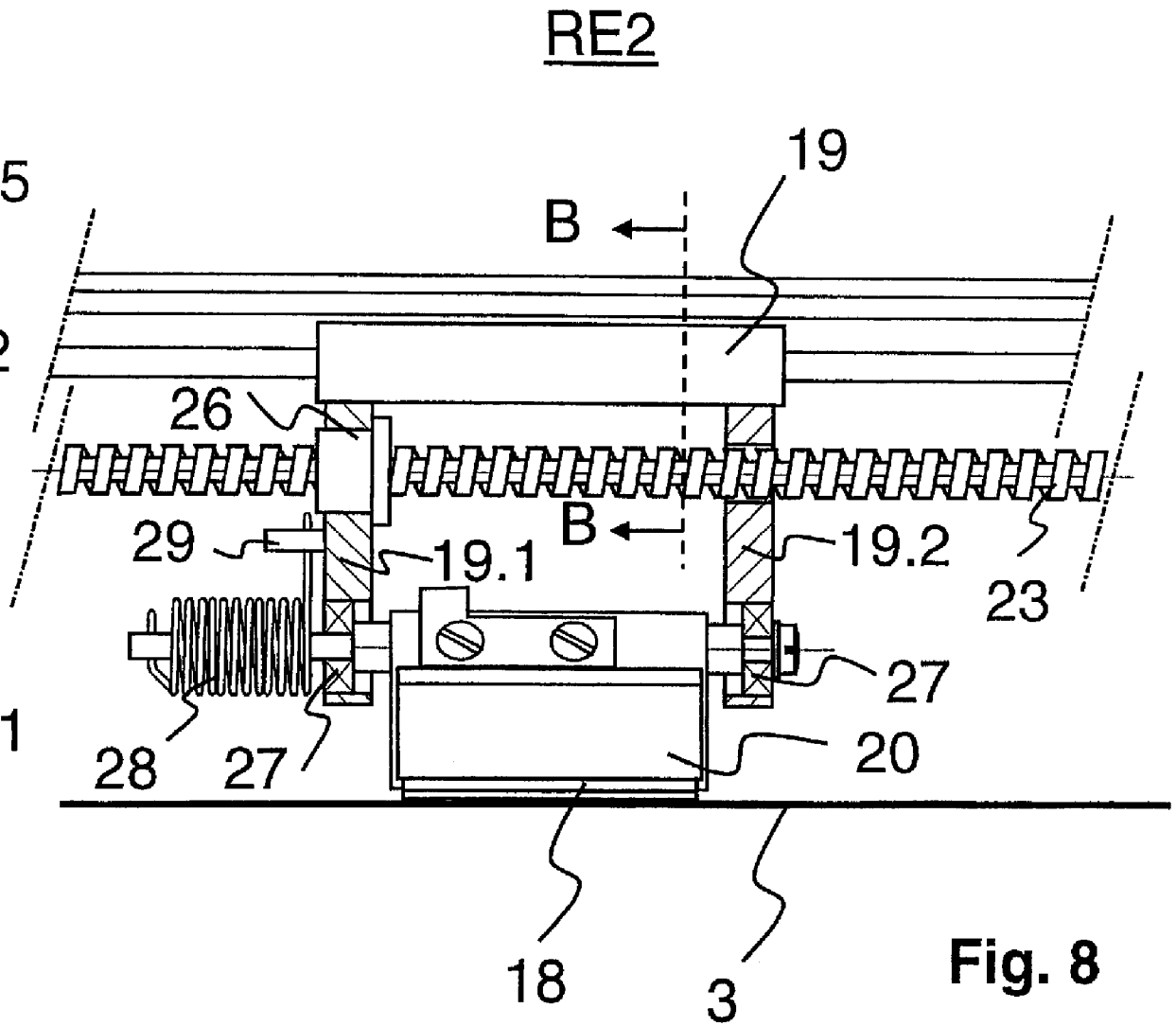
FIG. 8 is a cutout of the cleaning element according to FIG. 5 in front view.

To clean the photoconductor belt 3, the cleaning arrangement RA2 thus has the cleaning element RE2 with a cleaning blade 18 that is borne corresponding to FIGS. 6 and 8. It arises from FIG. 5, 8 that the cleaning blade 18 has a smaller width in comparison to the width of the photoconductor belt 3 that is to be cleaned. For example, the cleaning blade 18 can have a width b1 of 1/10 of the width b2 of the photoconductor belt 3 that is to be cleaned. According to FIGS. 5 and 8, the cleaning element RE2 furthermore provides a sled 19 with legs 19.1 and 19.2 between which the accommodation linkage 20 for the cleaning blade 18 is borne such that it can rotate in a rotation axle 21. The sled 19 has a guide groove 22 at the other end.

The drive unit AM2 has a drive motor 24, a drive spindle 23 driven by the drive motor 24 and a guide rail 25 to guide the sled 19. The drive spindle 23 is coupled with the sled 19 such that the cleaning element RE2 can be moved on the guide rail 25 via rotation of the drive spindle 23. For this the sled 19 of the cleaning element RE2 has the guide groove 22 in which the guide rail 25 is arranged.

The sled 19 of the cleaning element RE2 is thus coupled with the drive 23 such that the sled 19 (and therefore the cleaning blade 18) can be moved transversely across the photoconductor belt 3 in one or the other direction via rotation of the drive spindle 23 in one or the other direction. Via this embodiment of the cleaning arrangement RA2 it is possible to move the cleaning blade 18 back and forth, wherein the cleaning blade 18 is set so as to continuously rest on the photoconductor belt 3 for cleaning due to the elastic force of the torsion spring 28 (see FIG. 8). The width b1 of the cleaning blade 18 is thereby selected so as to be smaller in comparison to the width b2 of the photoconductor belt 3. For example, the width can be chosen as b1=1/10*b2 to ½*b2.

FIG. 5 shows the position of the cleaning element RE2 (and thus of the sled 19 and of the cleaning blade 18) in its one end position; FIG. 7 shows it in its other end position. Via rotation of the drive spindle 23, the sled 19 is moved out from its one end position (FIG. 5) and into its other end position (FIG. 7); the cleaning blade 18 thereby continuously rests on the photoconductor belt 3 and respectively cleans a surface region of the surface of the photoconductor belt 3.

A section through the cleaning element RE2 at the point B-B of FIG. 5 results from FIG. 6. The cleaning blade 18 is arranged in the accommodation linkage 20 that is borne such that it can rotate in the legs 19.1 and 19.2 of the sled 19. The sled 19 has the guide groove 22 at the other end (relative to the accommodation linkage 20), in which guide groove 22 the guide rail 25 of the drive unit AM2 runs. The cleaning element RE2 can be moved transverse to the photoconductor belt 3 with the drive spindle 23, which in the sled 19 runs in a threaded bushing 26 (FIG. 8). For this the drive spindle 23 must be rotated by the drive motor 24.

FIG. 8 shows in a front view a section of the cleaning arrangement RA2 in an enlarged depiction. The sled 19 has the two legs 19.1 and 19.2 between which the accommodation linkage 20 with the cleaning blade 18 is borne such that it rotates on a rotation axle 21 in bearings 27. The accommodation linkage 20 with the cleaning blade 18 is under the elastic force of a torsion spring 28 that is attached to the leg 19.2 with a mount 29 and exerts an elastic force in the direction towards the photoconductor belt 3. The drive spindle 23 is directed by the legs 19.1 and 19.2 of the sled 19, wherein the drive spindle 23 runs in the threaded bushing 26 in the leg 19.1; in contrast to this, it is directed through the other leg 19.2 without an active connection. A rotation of the drive spindle 23 transfers via the threaded bushing 26 to the cleaning element RE2, with the result that the cleaning element RE2 is moved to the right or left (relative to FIG. 8) depending on the rotation direction of the drive spindle 23. Given this rotation of the cleaning element RE2, the cleaning blade 18 continuously rests on the photoconductor belt 3 and cleans a partial region of the surface of the photoconductor element 3.

Figure 9:
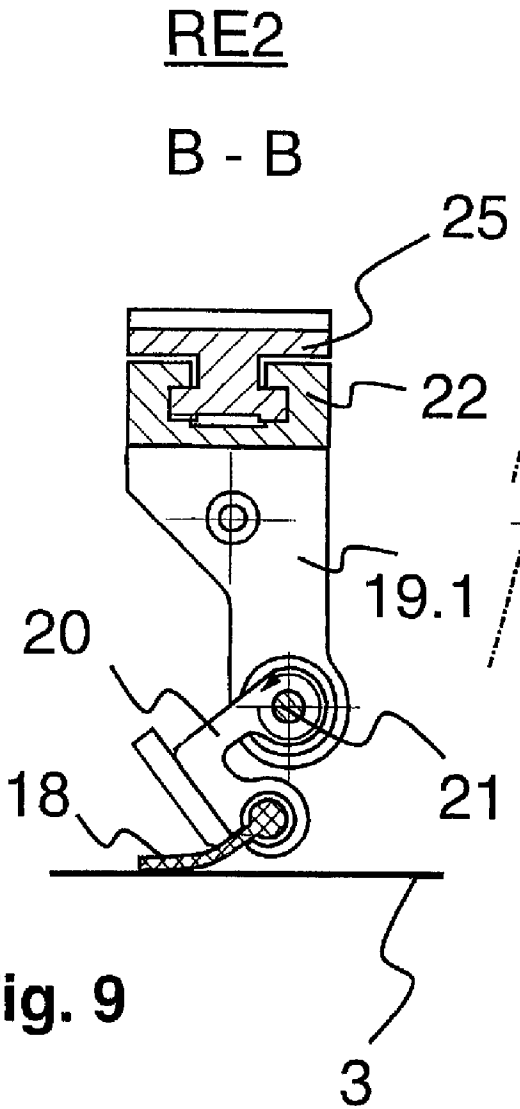
FIG. 9 is a second sectional view through the cleaning arrangement according to FIG. 8 at the point B-B.

FIG. 9 corresponds to FIG. 6; refer to the explanation regarding FIG. 6.

In the second embodiment of the cleaning arrangement RA2, the movement of the cleaning element RE2 occurs via a drive spindle 23. The preferred embodiment is not limited to this; rather, any drive unit AM2 can be used that can move the cleaning element RE2 back and forth.

In the cleaning arrangement RA2, a cam device with which the cleaning element RE2 can be pivoted off of the photoconductor belt 3 (for example in printing pauses) or can be pivoted onto the photoconductor belt 3 again after the print pauses can likewise be provided corresponding to FIGS. 2 through 4.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

I claim as my invention:

1. A cleaning arrangement for a moving element to be cleaned in an electrographic printing apparatus, comprising:

a cleaning element that has a cleaning member that, for cleaning, rests on a surface of the moving element to be cleaned;

a drive unit for the cleaning element that actuates the cleaning element such that the cleaning member cleans the surface of the moving element to be cleaned region-by-region;

the cleaning member resting on the element to be cleaned having a width of the element to be cleaned;

the cleaning member being arranged on one end of an accommodation linkage that is borne at its other end such that it can rotate on a rotation axle arranged in limbs of a pillow block;

a spring element arranged on the accommodation linkage that exerts an elastic force on the accommodation linkage and the cleaning element in the direction of the element to be cleaned; and said drive unit comprising a cam device that pivots the cleaning member of the cleaning element onto the element to be cleaned during time intervals and pivots said cleaning member away again after expiration of said time intervals.

2. The cleaning arrangement according to claim 1 wherein the spring element is designed as a torsion spring that is arranged at a rotation axle of the accommodation linkage.

3. The cleaning arrangement according to claim 1 wherein the cam device has a cam driven by a cam motor, and on the cam one end of an arm rests, the other end of the arm being coupled with the cleaning member such that said cleaning member is pivoted onto or off of the element to be cleaned via rotation of the cam.

4. A cleaning arrangement for a moving element having a photoconductor surface to be cleaned in an electrographic printing apparatus, comprising:

a cleaning element that has a cleaning member that, for cleaning, rests on said photoconductor surface of the moving element to be cleaned, said cleaning member having a width less than a width of the photoconductor surface of the moving element; and a drive unit for the cleaning element that moves the cleaning element during the cleaning back and forth across at least a portion of said width of said photoconductor surface to be cleaned in a direction transverse to a movement direction of said moving element.

5. The cleaning arrangement according to claim 4 wherein said drive unit is coupled with the cleaning element and moves the cleaning element back and forth transverse to said movement direction of the moving element to be cleaned.

6. The cleaning arrangement according to claim 5 in which the width of the cleaning member is in a range from ½ to 1/10 of the width of the photoconductor surface of the moving element to be cleaned.

7. The cleaning arrangement according to claim 4 wherein the cleaning element is arranged in a guide aligned transverse to said movement direction of the moving element to be cleaned so that said cleaning element resting on the element to be cleaned is moved transversely relative to the movement direction of said moving element to be cleaned.

8. The cleaning arrangement according to claim 7 wherein a drive spindle driven by a drive motor is provided as said drive unit, said drive spindle being coupled to the cleaning element so that said cleaning element is moved in the guide upon rotation of the drive spindle.

9. The cleaning arrangement according to claim 4 wherein:

the cleaning element has a sled and the cleaning member is arranged at one end of an accommodation linkage that is borne at its other end such that it can rotate on a rotation axle arranged in the sled;

a spring element arranged on the accommodation linkage that exerts an elastic force on the accommodation linkage and the cleaning member in a direction of the moving element to be cleaned; and the sled has a guide groove in which a guide rail of the drive unit is arranged transverse to the movement direction of the moving element to be cleaned.

10. The cleaning arrangement according to claim 9 wherein:

the sled has two legs between which the accommodation linkage is borne; and a drive spindle is directed through the leg such that the drive spindle runs into a threaded bushing in the one leg and is directed through the other leg without active connection.

11. The cleaning arrangement according to claim 4 wherein a cam device is arranged at the cleaning element, said cam device has a cam driven by a cam motor, on said cam one end of an arm rests, and an other end of the arm is coupled with the cleaning element such that the cleaning member is pivoted onto or away from the photoconductor surface of the moving element to be cleaned via rotation of the cam.

12. The cleaning arrangement according to claim 4 wherein the cleaning member comprises a cleaning blade that is aligned in a direction of movement of the moving element to be cleaned.

13. The cleaning arrangement according to claim 4 wherein said moving element with said photoconductor surface to be cleaned comprises a photoconductor belt for receiving charge images thereon which are developed by toner, a cleaning unit being arranged in contact with the photoconductor belt to remove residue toner, and said cleaning arrangement removing a film of said toner not removed by said cleaning unit.

14. The cleaning arrangement of claim 4 wherein said moving element with said photoconductor surface to be cleaned comprises a photoconductor belt and said cleaning arrangement removes a film of toner on said belt.

15. The cleaning arrangement of claim 4 wherein said cleaning member width is less than a width of the photoconductor surface of a photoconductor belt.

16. The cleaning arrangement of claim 4 wherein a device is provided with which the cleaning element can be pivoted off of the photoconductor surface of the moving element to be cleaned, or can be pivoted onto the photoconductor surface of the moving element to be cleaned.

17. A cleaning arrangement for a moving photoconductor belt having a photoconductor surface to be cleaned in a electrographic printing apparatus, comprising:

a cleaning element that has a cleaning member to remove a toner film on the photoconductor surface of the photoconductor belt and that, for cleaning, rests on the photoconductor surface of the moving element to be cleaned, said cleaning member having a width less than a width of the photoconductor surface of the moving element; and a drive unit for the cleaning element that moves the cleaning element during the cleaning back and forth across at least a portion of said width of the photoconductor surface of said element to be cleaned in a direction perpendicular to a movement direction of the moving element.

* * * * *